US005168015A

United States Patent [19]

Shimizu et al.

[11] Patent Number: 5,168,015

[45] Date of Patent: Dec. 1, 1992

[54] COMPOSITION AND METHOD FOR WELDABLE TIN-FREE STEEL HAVING A CHROMIUM BILAYER

[75] Inventors: Nobuyoshi Shimizu; Fumio Kunishige; Hideaki Hamano, all of Kudamatsu; Tsuneo Inui, Tokuyama, all of Japan

[73] Assignee: Toyo Kohan Co., Ltd., Tokyo, Japan

[21] Appl. No.: 663,078

[22] Filed: Feb. 28, 1991

Related U.S. Application Data

[63] Continuation of Ser. No. 359,033, May 30, 1989, abandoned.

[51] Int. Cl.[5] ..... C25D 5/48; C25D 11/38

[52] U.S. Cl. ..... 428/629; 205/156; 205/179; 205/223; 205/229; 205/319; 428/667; 428/935

[58] Field of Search ..... 204/27, 28, 35.1, 56.1; 428/667, 629, 935; 205/142, 156, 179, 223, 229, 319

[56] References Cited

U.S. PATENT DOCUMENTS 3,860,398 1/1975 Tsurumaru et al. ..... 428/667 X
3,986,940 10/1976 Takano et al. ..... 204/28
4,392,582 7/1983 Kitamura et al. ..... 220/75
4,432,842 2/1984 Inui et al. ..... 204/41
4,455,355 6/1984 Inui et al. ..... 428/595
4,842,958 6/1989 Higuchi et al. ..... 428/629

*Primary Examiner*—John Niebling
*Assistant Examiner*—William T. Leader
*Attorney, Agent, or Firm*—Felfe & Lynch

[57] ABSTRACT

A method for producing a tin free steel having double layers consisting of a lower layer of flatly deposited metallic chromium and an upper layer of insoluble hydrated chromium oxide which is characterized by a dissolution of soluble hydrated chromium oxide after the formation of three layers consisting of a bottom layer of metallic chromium, a middle layer of insoluble hydrated chromium oxide and an upper layer of soluble hydrated chromium oxide on a steel base by using a chromic acid electrolyte with a small amount of fluoride compound.

By using this tin free steel, a welded can body can be produced at high speed without the removal of the plated layer in the welded part because this tin free steel has an excellent weldability.

3 Claims, 4 Drawing Sheets

COMPOSITION AND METHOD FOR WELDABLE TIN-FREE STEEL HAVING A CHROMIUM BILAYER

This application is a continuation of application Ser. No. 859,033, filed May 30, 1989, now abandoned.

FIELD OF THE INVENTION

The present invention relates to a method for producing a tin free steel having excellent weldability. In detail, the invention relates to a method for producing a tin free steel having double layers consisting of a lower layer of flatly deposited metallic chromium and an upper layer of an uniformly formed insoluble hydrated chromium oxide. It is characterized by a dissolution of soluble hydrated chromium oxide after the formation of three layers consisting of a bottom layer of metallic chromium, a middle layer of insoluble hydrated chromium oxide and an upper layer of soluble hydrated chromium oxide on a steel base by using a chromic acid electrolyte with a small amount of fluoride compound.

By using this tin free steel, a welded can body can be produced at high speed without the removal of the plated layer in the welded part.

SUMMARY

The method for producing a tin free steel having excellent weldability according to the present invention was developed by the detailed investigation.

The objective of the present invention can be accomplished by providing a tin free steel having double layers consisting of a lower layer of metallic chromium of the restricted amount and an upper layer of insoluble hydrated chromium oxide of the restricted amount on a steel base by using a chromic acid electrolyte with a small amount of fluoride compound (fluoride bath). The method according to the present invention is characterized by the following factors:

(1) The use of a fluoride bath for the formation of said three layers on a steel base.

(2) The dissolution of soluble hydrated chromium oxide being the upper layer of said three layers after the formation of said three layers on a steel base by an immersion into said fluoride bath.

(3) The restriction of the range in the amount of the deposited metallic chromium.

(4) The restriction of the range in the amount of the formed insoluble hydrated chromium oxide.

The tin free steel according to the present invention is easily welded at high speed without the removal of the plated layer and also can be used in applications wherein excellent weldability is required, such as food can bodies, aerosol can bodies and miscellaneous can bodies which are lacquered except the welded part before welding. Furthermore, the tin free steel according to the present invention can be also used for can ends and drawn cans because it has excellent corrosion resistance after lacquering comparable to that of the ordinary tin free steel.

DESCRIPTION

Background and Objective

In the description, soluble hydrated chromium oxide means the hydrated chromium oxide which is easily dissolved before drying into the fluoride bath or chromic acid solution without additives before drying and insoluble hydrated chromium oxide means the hydrated chromium oxide which is difficult to dissolve into the fluoride bath or chromic acid solution without additives even before drying.

Recently, the change from expensive electrotinplates to cheaper tin free steel having double layers consisting of a lower layer of metallic chromium and an upper layer of hydrated chromium oxide has rapidly taken place in the field of food and beverage cans, five gallon cans and miscellaneous cans. This is because the tin used for the production of tinplate is expensive and tin free steel has excellent lacquer adhesion compared with that of tinplate.

An ordinary metal can made of tin free steel consists of two can ends and a single can body, except for drawn can. In the case of tin free steel, the seaming of the can body is generally carried out with nylon adhesives by using the Toyo Seam (Trade name) and Mira Seam (Trade name) method. Another method of seaming a tin free steel can body by electric welding is also well known. In the case of the seaming of a tin free steel can body by electric welding such as the Soudronic process, however, the metallic chromium layer and the hydrated chromium oxide layer must be mechanically or chemically removed from the tin free steel surface in order to easily obtain a well seamed can body at high speed. Therefore the corrosion resistance in the welded part of the tin free steel can body becomes remarkably poor, even if this welded part is coated with lacquer after welding.

From the background described above, the development of a can material which is cheaper than tinplate and is easily weldable at high speed without the removal of the plated layer, has been required, especially in the field of food cans.

Recently, various methods for producing tin free steel which can be easily welded at high speed without the removal of the plated layer have been proposed. For instance, the methods shown in Japanese Patent Publication Nos. Sho 57-19752, Sho 57-36986 and Laid-Open Japanese Patent Application Nos. Sho 61-213398, Sho 63-186894 have been already known.

Japanese Patent Publication No. Sho 57-19752 relates to a tin free steel with excellent weldability having double layers consisting of a lower layer of metallic chromium of 3 to 40 mg/m$^2$ and an upper layer of non-metallic chromium which is mainly chromium oxide of 2 to 15 mg/m$^2$ as chromium. This Sho 57-19752 intends to improve the weldability of tin free steel by the formation of a porous metallic chromium layer with a small amount of metallic chromium. However, it is considered that not only the weldability but also corrosion resistance are poor, because the iron oxide film having high electric resistance is formed by the oxidation of the steel base deliberately exposed through the pore of metallic chromium layer during the lacquer curing.

Japanese Patent Publication No. Sho 57-36986 is characterized by the use of a chromic acid electrolyte with a small amount of anions such as sulfate ion, nitrate ion and chloride ion in order to produce a tin free steel with excellent weldability, formability and lacquerability which has metallic chromium of 0.5 to 30 mg/m$^2$ and hydrated chromium oxide of 2 to 50 mg/m$^2$ as chromium. This method for producing the tin free steel intends to improve the corrosion resistance, which becomes poor by a decrease in the amount of metallic chromium, by the improvement of the quality of the hydrated chromium oxide layer. However, the weldability of the tin free steel obtained by this method will be not improved because the exposed steel surface is oxidized by heating the lacquer coated tin free steel similar to Sho 57-19752 described above.

Laid-Open Japanese Patent Application No. Sho 61-213398 relates to a tin free steel for a welded can with excellent corrosion resistance after lacquering which has flatly deposited metallic chromium of 10 to 40 mg/m$^2$ and uniformly formed hydrated chromium oxide of 3 to 30 mg/m$^2$ as chromium. The method for producing this tin free steel is characterized by the dissolution of a part of the deposited metallic chromium by an anodic treatment after the formation of a double layer consisting of metallic chromium and hydrated chromium oxide. However, it is considered that the weldability of the tin free steel obtained by this method will be not improved because of the increase of the exposed steel base with the increase of the pore in the metallic chromium layer.

Laid-Open Japanese Patent Application No. Sho 63-18689 relates to a tin free steel for a welded can having metallic chromium of 50 to 150 mg/m$^2$ and hydrated chromium oxide of 5 to 20 mg/m$^2$ as chromium. The tin free steel obtained by Sho 63-186894 is characterized by the granular deposition of metallic chromium. This tin free steel was developed based on the fact that an electric contact resistance, which is used for one of the index of the evaluation of the weldability, became lower by the granular deposition of metallic chromium.

The weldability is usually evaluated by an available secondary current range in welding, that is, the wider the secondary current range in welding, the better the weldability. On determining the available secondary current range in welding, the upper limit corresponds to the welding conditions in which some defect such as splashing is found and the lower limit corresponds to the welding conditions in which the breakage occurs in the welded part by the tearing test. However, the weldability is usually evaluated by a simple method of electric contact resistance measurement, which has an apparent correlation to the available secondary current range in welding, because a large number of samples are necessary in order to determine the available secondary current range in welding.

Namely, the lower the electric contact resistance, the wider the available secondary current range in welding.

Although the electric contact resistance has an apparent correlation to the available secondary current range in welding for tin free steels having almost the same morphology of metallic chromium, this correlation is not recognized for tin free steels having the different morphology of metallic chromium. For example, in the case of a tin free steel having granularly deposited metallic chromium obtained by Sho 63-186894, the available secondary current range in welding is narrow in spite of the low electric contact resistance.

Therefore, the weldability of tin free steel is not evaluated by only the electric contact resistance, although the electric contact resistance is used as the index of the evaluation of the weldability for tin free steels having almost the same morphology of metallic chromium.

In general, there are two well-known types of method for producing an ordinary tin free steel. The first type is a one-step method in which metallic chromium and hydrated chromium oxide are formed in one operation by using one electrolyte composition. The second type is a two-step method in which metallic chromium is formed first by using one electrolyte composition as a chromium plating solution, and then hydrated chromium oxide is formed on the metallic chromium layer by using another electrolyte composition. In both types of processes, a chromic acid electrolyte with a fluoride compound (fluoride bath), with a sulfate compound (sulfate bath) or with both additives (mixed bath) are usually used. It has been known in the report by K. Yoshida et al. (Kinzoku Hyomen Gijutsu, vol. 30, No. 7, 1979, page 338) that the film in the ordinary tin free steel produced by the methods described above is constructed of three layers consisting of a bottom layer of metallic chromium, a middle layer of insoluble hydrated chromium oxide which is mainly equivalent to chromium oxide and an upper layer of soluble hydrated chromium oxide. Namely, the hydrated chromium oxide is constructed by two layers having different structures.

Figure 3:
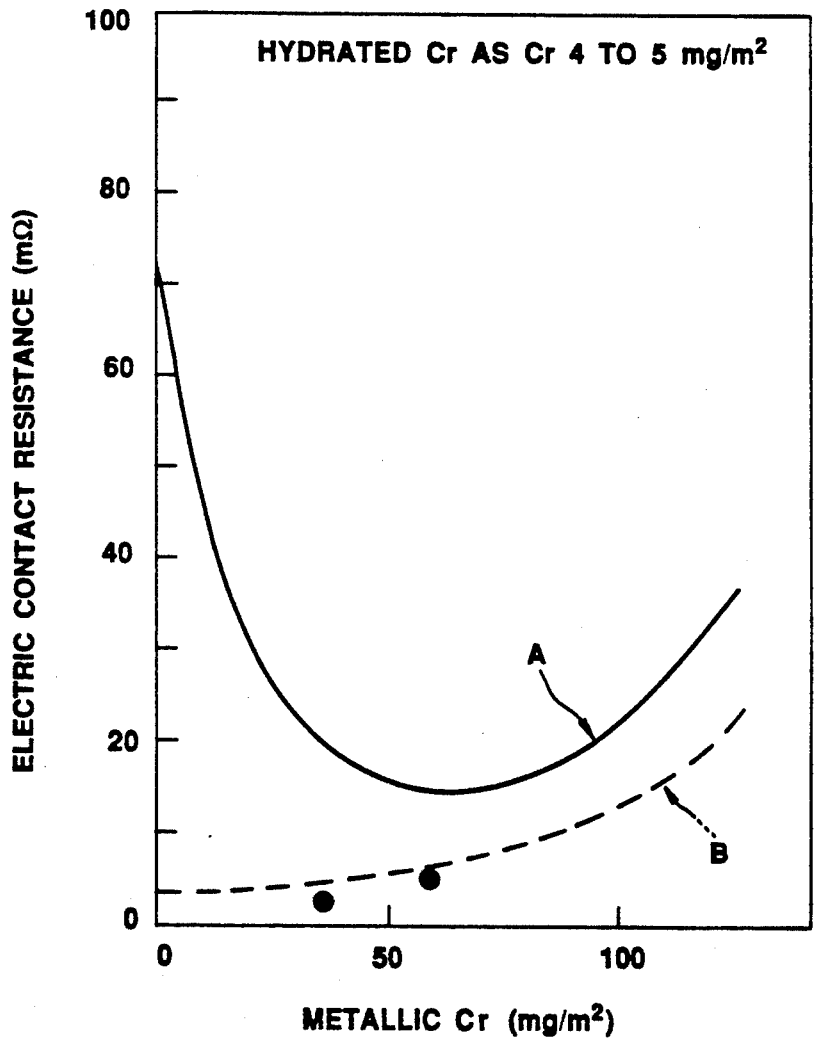
FIG. 3 shows the effect of the amount of metallic chromium on the electric contact resistance of the tin free steel produced using the fluoride bath described above before heating (B) and after heating at 210° C. for 20 minutes (A).
Figure 4:
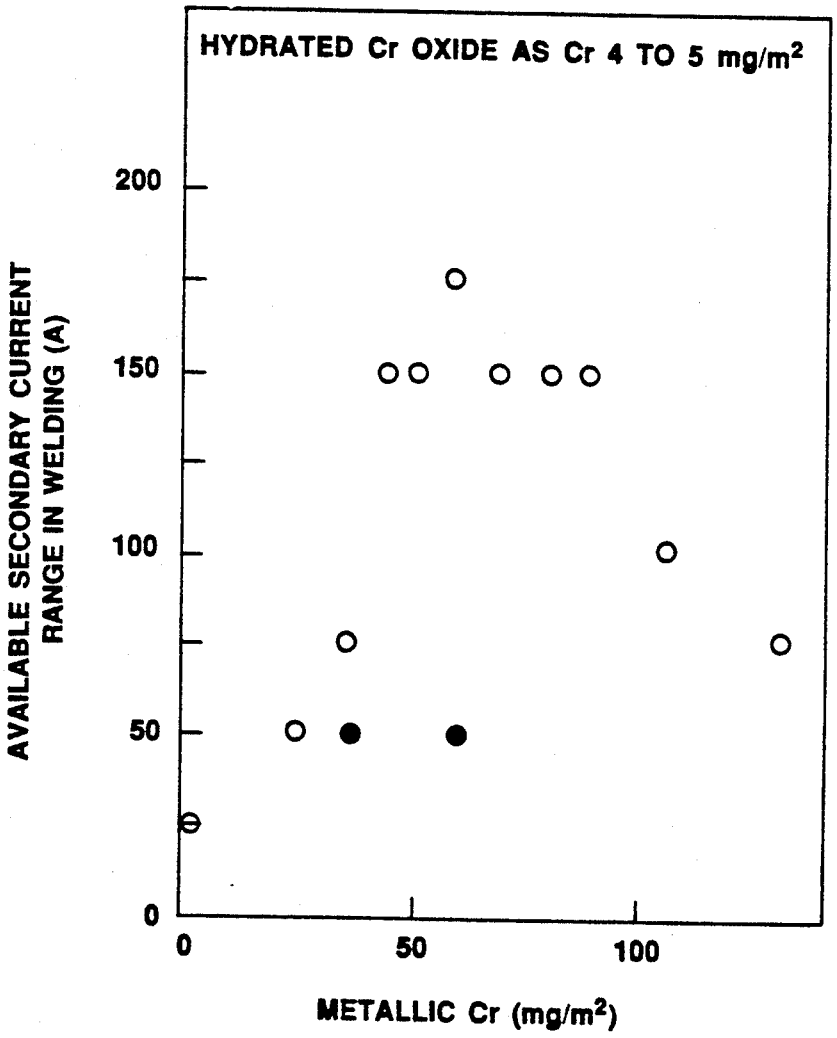
FIG. 4 shows the effect of the amount of metallic chromium on the available secondary current range in welding of the tin free steel produced by using the fluoride bath described above after heating at 210° C.for 20 minutes.

The black points in FIG. 3 and FIG. 4 show the electric contact resistance and the available secondary current range of the tin free steel having granular deposition of metallic chromium, which is produced by an anodic treatment after cathodic treatment of a steelsheet in a mixed bath described above, after heating at 210° C. for 20 minutes, respectively.

DETAILED DESCRIPTION OF THE INVENTION

The steel base used for the production of the tin free steel according to the present invention can be any cold rolled steel sheet customarily used in manufacturing electrotinplate and ordinary tin free steel. Preferably, the thickness of the steel base is from about 0.1 to about 0.35 mm.

The tin free steel according to the present invention is produced by the following processes: degreasing with an alkali and pickling with an acid, then water rinsing, then forming said three layers consisting of metallic chromium, insoluble hydrated chromium oxide and soluble hydrated chromium oxide, then dissolving of the soluble hydrated chromium oxide by an immersion into the electrolyte, and water rinsing and then drying.

In the process described above, water rinsing after the formation of said three layers may be added, if the chromic acid solutions used for the formation of said three layers and the dissolution of soluble hydrated chromium oxide have the different composition in order to control the concentration of each composition.

Figure 1:
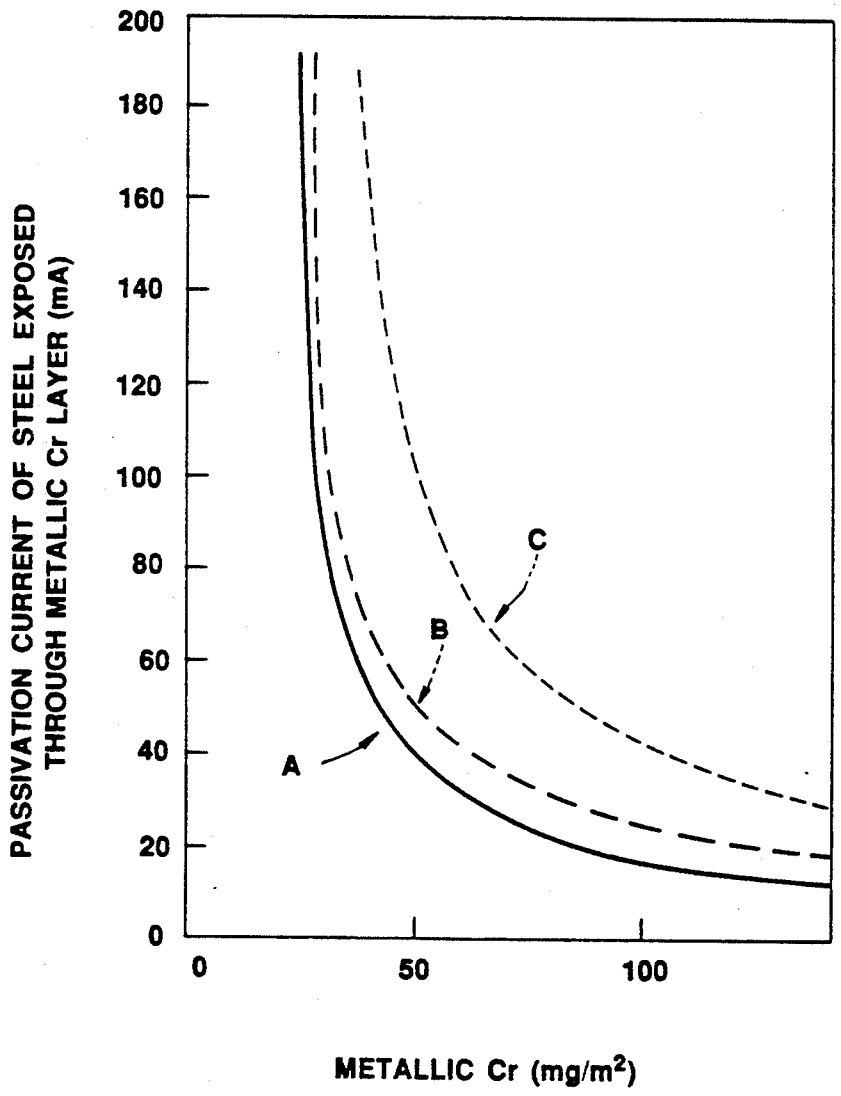
FIG. 1 shows the relationship between the amount of metallic chromium and the passivation current of the steel base exposed through the metallic chromium layer after the dissolution of the formed hydrated chromium oxide by an immersion into hot sodium hydroxide solution. A shows that obtained by using a fluoride bath ($CrO_3$: 100 g/L, $NH_4F$:5 g/1) under the cathodic current density of 50 A/dm$^2$ at 50° C. B and C show those obtained by using a mixed bath ($CrO_3$:150 g/1, $H_2SO_4$:0.8 g/1, $Na_2SiF_6$:5 g/1) and a sulfate bath ($CrO_3$:160 g/1, $H_2SO_4$:2.5 g/1) under the cathodic current density of 50 A/dm$^2$ at 60° C. respectively.

In the present invention, it is preferable to employ a fluoride bath for the following reasons:

(1) The area f the steel base exposed through the pore of the formed metallic chromium layer is smaller than that in a sulfate bath and mixed bath at the same amount of metallic chromium as shown in FIG. 1. Namely, the steel base is uniformly covered with a small amount of metallic chromium compared with that in a sulfate bath. In the case of a mixed bath, the addition of a large amount of sulfuric ion is not preferable because the area of the steel base exposed from the metallic chromium layer increases.

(2) The flat deposition of metallic chromium is obtained by using a fluoride bath. On the other hand, the granular deposition of metallic chromium is obtained by using a sulfate bath. Therefore the steel surface is sufficiently covered with a small amount of metallic chromium compared with that in a sulfate bath.

(3) The thin and uniform soluble hydrated chromium oxide is formed by using a fluoride bath, since the structure of soluble hydrated chromium oxide is not disturbed by the fluorine incorporated into the hydrated chromium oxide which has nearly the same volume as the hydroxyl radical or bonded water in the hydrated chromium oxide. On the other hand, the thick and non-uniform soluble hydrated chromium oxide is formed by using a sulfate bath, since the structure of the soluble hydrated chromium oxide is disturbed by the incorporated sulfate ion having the same volume as trivalent chromium coordinated by a hydroxyl radical or bonded water with a coordination number of 6. The formation of a thinner soluble hydrated chromium oxide is preferable in order to easily dissolve the formed soluble hydrated chromium oxide in a short time.

(4) The film having a thinner and uniform insoluble hydrated chromium oxide is formed by using a fluoride bath compared with that in a sulfate bath.

It is indispensable in the present invention that each layer of the formed three layers is thin and uniform in order to produce continuously at high speed a tin free steel having excellent weldability. Therefore, the use of a fluoride bath in the present invention is preferable because the fluoride bath has the various merits described above.

In the case of the fluoride bath, the following electrolytic conditions for the formation of said three layers on a steel base should be selected:

Concentration of chromic acid: 50 to 300 g/l, more preferably 80 to 200 g/l.

Concentration of fluoride compound: 1.0 to 10.0 weight %, more preferably 1.0 to 8.0 weight % of chromic acid.

Temperature of the electrolyte: 40° to 60° C. more preferably 50° to 60° C.

Cathodic current density: 20 to 100 A/dm$^2$, more preferably 40 to 100 A/dm$^2$.

The amount of soluble hydrated chromium oxide in the formed three layers decreases with an increase of the chromic acid concentration with a suitable weight ratio of fluoride compound under higher cathodic current density at higher temperature of the electrolyte.

Therefore, it is not preferable to use a fluoride bath having below 30 g/l of chromic acid under the cathodic current density below 20 A/dm$^2$ at the temperature of the fluoride bath below 40° C. in order to form thin soluble hydrated chromium oxide. Furthermore, the use of a fluoride bath having below 30 g/l of chromic acid, the temperature of the fluoride bath of above 60° C. and the current density of below 20 A/dm$^2$ is not preferable, because the current efficiency for the deposition of metallic chromium decreases remarkably. However, the concentration of chromic acid above 300 g/l and the cathodic current density above 100 A/dm$^2$ is not suitable for the deposition of a small amount of metallic chromium from an economical point of view.

The presence of fluoride compound in the electrolyte used for producing the tin free steel according to the present invention is indispensable for a uniform three layers. If the weight % of fluoride compound to chromic acid is below 1.0 or above 10.0, the current efficiency for the deposition of metallic chromium remarkably decreases, besides a decrease of the uniformity of the deposited metallic chromium layer. Particularly, at below 1.0 weight % of fluoride compound to chromic acid, the weldability becomes remarkably poor, because the thick and non-uniform insoluble hydrated chromium oxide is formed.

It is preferable that the fluoride compound is at least one compound selected from the group consisting of hydrofluoric acid, fluoboric acid, fluosilicic acid, ammonium bifluoride, an alkali metal bifluoride, ammonium fluoride, an alkali metal fluoride, ammonium fluoborate, an alkali metal fluoborate, ammonium fluosilicate, an alkali metal fluosilicate and aluminum fluoride.

Figure 2:
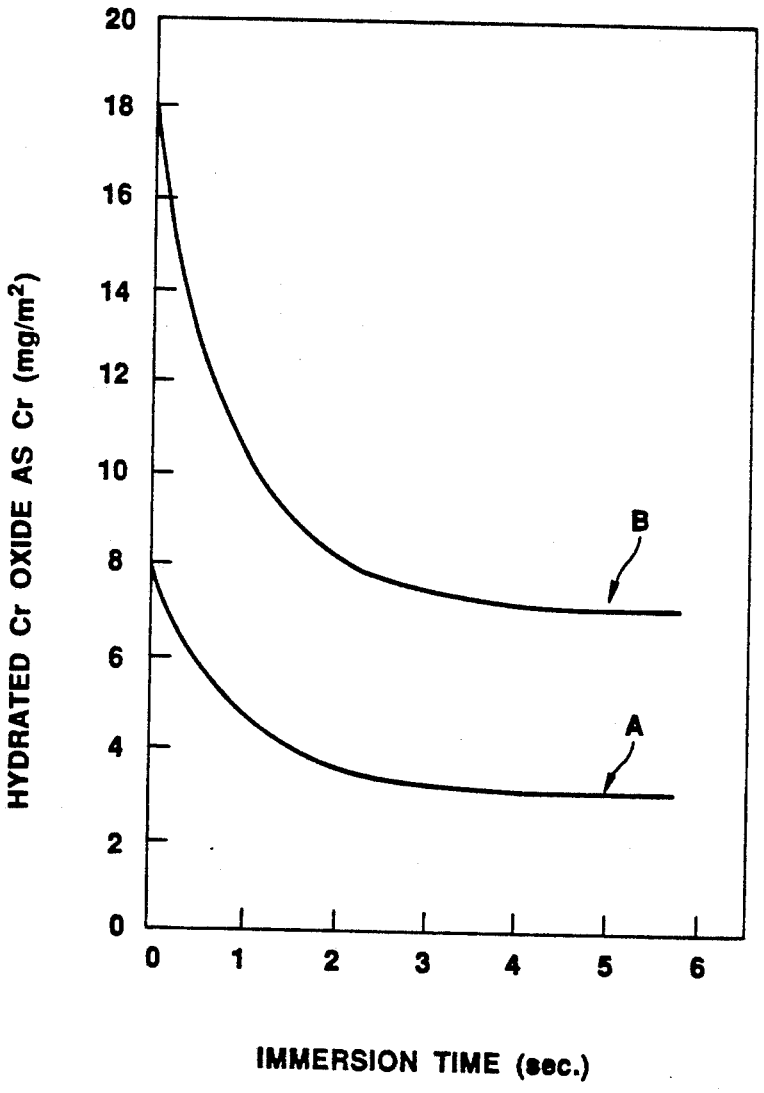
FIG. 2 shows one example of the effect of the immersion time into a chromic acid electrolyte on the amount of the remained insoluble hydrated chromium oxide. A and B show those obtained by using the fluoride bath and the mixed bath described above for the formation and the dissolution of hydrated chromium oxide, respectively.

The formed soluble hydrated chromium oxide which is the upper layer of said three layers should be removed before water rinsing and drying in the process for producing the tin free steel having excellent weldability according to the present invention. It is suitable to employ the fluoride bath, which is used for the formation of said three layers on a steel base, in order to dissolve the soluble hydrated chromium oxide in said three layers from an economical point of view, although a chromic acid solution without additives or with another additives can be also used. The concentration of chromic acid and the temperature of the solution for the dissolution of the formed soluble hydrated chromium oxide should be controlled above 30 g/l and above 40° C. respectively, in order to sufficiently dissolved the soluble hydrated chromium oxide in a short time. The concentration of chromic acid above 300 g/l and the temperature above 60° C.are not suitable for the dissolution of the soluble hydrated chromium oxide from an economical point of view. The immersion time is a very important factor in the process for producing the tin free steel according to the present invention. As shown in FIG. 2, the amount of insoluble hydrated chromium oxide becomes almost constant in above 2.5 seconds of immersion time. In the present invention, the immersion time should be controlled in the range of 2.5 to 10 seconds, because the immersion above 10 seconds needs a large space in a case of the continuous production of the tin free steel according to the present invention at high speed. An anodic treatment in the fluoride bath after the formation of said three layers is also considered for the dissolution of the formed soluble hydrated chromium oxide. However, this method is not suitable in the present invention, because the area of the steel base exposed through the metallic chromium layer increases by the anodic dissolution of metallic chromium.

The amount of metallic chromium in the tin free steel according to the present invention should be controlled in the range of 45 to 90 mg/m$^2$. If the amount of metallic chromium is below 45 mg/m$^2$, excellent weldability after heating for lacquer curing is not obtained, because the area of the steel base exposed through the formed metallic chromium layer increases remarkably as shown in FIG. 1. The increase in the area of the steel base exposed through the formed metallic chromium leads to the increase in the electric contact resistance as shown in FIG. 3 and the narrow range of the secondary current in welding as shown in FIG. 4, because the iron oxide film having higher electric resistance is formed by the oxidation of the exposed steel base. If the amount of metallic chromium is above 90 mg/m$^2$, the weldability becomes also poor by an increase in the amount of metallic chromium having bad forging ability compared with that in the steel base as shown in FIG. 3 and FIG. 4, although the area of the steel base exposed from the metallic chromium layer decreases with an increase of the amount of metallic chromium. It is found from FIG. 3 and FIG. 4 that the electric contact resistance has an apparent correlation to the available secondary current range in welding in the case of the tin free steel having almost the same morphology of metallic chromium according to the present invention.

On the contrary, other tin free steel having a granular deposition of metallic chromium has a narrow available secondary current range in welding, in spite of low electric contact resistance as shown in FIG. 3 and FIG. 4.

It is generally well known that the weldability of the ordinary tin free steel depends on the amount of hydrated chromium oxide having higher electric resistance after heating for curing the coated lacquer. That is, the lower the amount of hydrated chromium oxide, the better the weldability. However, the decrease in the amount of hydrated chromium oxide is not suitable from the point of the corrosion resistance after lacquering, although the weldability is improved. Especially, the presence of soluble hydrated chromium oxide is not suitable for producing a tin free steel having excellent weldability, because the uniformity of the formed soluble hydrated chromium oxide is poor, even if the amount of soluble hydrated chromium oxide is small. Practically, it is impossible to uniformly weld the can body of the ordinary tin free steel having a small amount of soluble hydrated chromium oxide without the removal of the plated layer at high speed, because the electrolytic contact resistance is different locally in the welded part.

On the other hand, the insoluble hydrated chromium oxide in said three layers is uniformly formed in comparison with the soluble hydrated chromium oxide. Furthermore, the amount of the formed insoluble hydrated chromium oxide is almost constant without the effects of the electrolytic conditions for the formation of said three layers. In the present invention, it is preferably to control in the range of 3 to 7 mg/m$^2$ as chromium the amount of the formed insoluble hydrated chromium oxide. It is industrially difficult to form the insoluble hydrated chromium oxide having below 2 mg/m$^2$ and above 10 mg/m$^2$ as chromium with metallic chromium and soluble hydrated chromium oxide except some special electrolytic conditions such as the use of a chromic acid electrolyte with little amount of additives. If the amount of insoluble hydrated chromium oxide is below 3 mg/m$^2$, the corrosion resistance after lacquering becomes remarkably poor, although the weldability is improved. The weldability becomes gradually poor with an increase in the amount of insoluble hydrated chromium oxide same as the increase in the amount of soluble hydrated chromium oxide. In the present invention, the allowable upper limit in the amount of insoluble hydrated chromium oxide is 7 mg/m$^2$ as chromium in order to uniformly weld without the removal of the plated layer at high speed.

The present invention is illustrated by the following examples. These examples serve to illustrate the invention and not to limit it. Others will be obvious to those skilled in the art.

In Example 1 to Example 5, a cold rolled steel sheet having a thickness of 0.22 mm was treated by the following process after electrolytically degreasing in a solution of 70 g/l of sodium hydroxide, water rinsing and then pickling in a solution of 100 g/l of sulfuric acid, followed by rinsing with water.

Formation of three layers consisting of a bottom layer of metallic chromium and a middle layer of insoluble hydrated chromium oxide and an upper layer of soluble hydrated chromium oxide by using a fluoride bath, then water rinsing, followed by immersion into a fluoride bath (chromic acid solution in Example 4 and Example 5) followed by water rinsing and then drying.

In each Example, the conditions are shown in detail. Condition A shows the electrolytic conditions for the formation of said three layers consisting of a bottom layer of metallic chromium, a middle layer of insoluble hydrated chromium oxide and an upper layer of soluble hydrated chromium oxide. Condition B shows the conditions for the dissolution of the formed soluble hydrated chromium oxide.

EXAMPLE 1

| | |
|---|---|
| **Condition A** | |
| Composition of electrolyte | |
| $CrO_3$ | 200 g/l |
| $NH_4F$ | 7 g/l |
| Temperature of electrolyte | 50° C. |
| Cathodic current density | 50 A/dm$^2$ |
| **Condition B** | |
| Solution for dissolution | the same composition as the above electrolyte |
| Temperature of solution | 50° C. |
| Immersion time | 3 seconds |

EXAMPLE 2

| | |
|---|---|
| **Condition A** | |
| Composition of electrolyte | |
| $CrO_3$ | 150 g/l |
| NaF | 5 g/l |
| Temperature of electrolyte | 58° C. |
| Cathodic current density | 70 A/dm$^2$ |
| **Condition B** | |
| Solution for dissolution | the same composition as the above electrolyte |
| Temperature of solution | 58° C. |

-continued

| | |
|---|---|
| Immersion time | 5 seconds |

EXAMPLE 3

| | |
|---|---|
| Condition A | |
| Composition of electrolyte | |
| $CrO_3$ | 80 g/l |
| $Na_2SiF_6$ | 6 g/l |
| Temperature of electrolyte | 55° C. |
| Cathodic current density | 30 A/dm$^2$ |
| Condition B | |
| Solution for dissolution | the same composition as the above electrolyte |
| Temperature of solution | 55° C. |
| Immersion time | 6 seconds |

EXAMPLE 4

| | |
|---|---|
| Condition A | |
| Composition of electrolyte | |
| $CrO_3$ | 100 g/l |
| $HBF_4$ | 3 g/l |
| NaF | 1 g/l |
| Temperature of electrolyte | 45° C. |
| Cathodic current density | 50 A/dm$^2$ |
| Condition B | |
| Solution for dissolution | $CrO_3$ 100 g/l |
| Temperature of solution | 50° C. |
| Immersion time | 8 seconds |

EXAMPLE 5

| | |
|---|---|
| Condition A | |
| Composition of electrolyte | |
| $CrO_3$ | 100 g/l |
| $NH_4F$ | 5 g/l |
| Temperature of electrolyte | 45° C. |
| Cathodic current density | 50 A/dm$^2$ |
| Condition B | |
| Solution for dissolution | $CrO_3$ 100 g/l |
| Temperature of solution | 45° C. |
| Immersion time | 8 seconds |

COMPARATIVE EXAMPLE 1

The same kind of steel sheet pretreated as in Example 1 was plated with metallic chromium and then was post treated under the following conditions, followed by rinsing with water and drying.

| | |
|---|---|
| Condition for metallic chromium deposition | |
| Composition of electrolyte | |
| $CrO_3$ | 200 g/l |
| $H_2SO_4$ | 1.5 g/l |
| Temperature of electrolyte | 50° C. |
| Cathodic current density | 50 A/dm$^2$ |
| Condition for post-treatment | |
| Composition of electrolyte | |
| $CrO_3$ | 60 g/l |
| Temperature of electrolyte | 55° C. |
| Cathodic current density | 10 A/dm$^2$ |

COMPARATIVE EXAMPLE 2

The same kind of steel pretreated as in Example 1 was treated under the following conditions and then rinsed with water and dried.

| | |
|---|---|
| Condition for treatment | |
| Composition of electrolyte | |
| $CrO_3$ | 50 g/l |
| $Na_2SiF_6$ | 1.5 g/l |
| Temperature of electrolyte | 55° C. |
| Cathodic current density | 20 A/dm$^2$ |

COMPARATIVE EXAMPLE 3

The same kind of steel sheet pretreated as in Example 1 was plated with metallic chromium and then anodically treated under the following conditions.

| | |
|---|---|
| Condition for metallic chromium deposition | |
| Composition of electrolyte | |
| $CrO_3$ | 50 g/l |
| $Na_2SiF_6$ | 6 g/l |
| $H_2SO_4$ | 0.8 g/l |
| Temperature of electrolyte | 55° C. |
| Cathodic current density | 50 A/dm$^2$ |
| Condition for anodic treatment | |
| Composition of electrolyte | the same composition as the above electrolyte |
| Temperature of electrolyte | 55° C. |
| Anodic current density | 3 A/dm$^2$ |
| Time for electrolysis | 0.2 seconds |

After that, the thus treated steel was cathodically treated under the following condition, followed by rinsing and drying.

| | |
|---|---|
| Condition for cathodic treatment | |
| Composition of electrolyte | |
| $CrO_3$ | 60 g/l |
| Temperature of electrolyte | 55° C. |
| Cathodic current density | 15 A/dm$^2$ |

COMPARATIVE EXAMPLE 4

The same kind of steel sheet pretreated as in Example 1 was plated with metallic chromium and then was anodically treated under the following conditions.

| | |
|---|---|
| Condition for metallic chromium deposition | |
| Composition of electrolyte | |
| $CrO_3$ | 200 g/l |
| $Na_2SiF_6$ | 7.5 g/l |
| $H_2SO_4$ | 0.5 g/l |
| Temperature of electrolyte | 50° C. |
| Cathodic current density | 60 A/dm$^2$ |
| Condition for anodic treatment | |
| Composition of electrolyte | the same composition as the above electrolyte |
| Temperature of electrolyte | 60° C. |
| Anodic current density | 5 A/dm$^2$ |
| Time for electrolysis | 0.2 seconds |

After that, this treated steel sheet was cathodically treated under the following conditions, followed by rinsing with water and drying.

| Condition for cathodic treatment | |
|---|---|
| Composition of electrolyte | |
| $CrO_3$ | 50 g/l |
| NaF | 4 g/l |
| Temperature of electrolyte | 40° C. |
| Cathodic current density | 15 A/dm$^2$ |

COMPARATIVE EXAMPLE 5

The same kind of steel sheet pretreated as in Example 1 was cathodically treated under the same conditions as in Example 2. After that, this treated steel sheet was rinsed with water and dried without the dissolution of the formed soluble hydrated chromium oxide.

Comparative Example 1, 2 and 3 and 4 shows one example in Japanese Patent Publication Nos. Sho 57-19752, Sho 57-36986, Laid-Open Japanese Patent Application Nos. Sho 61-213398 and Sho 63-186894 respectively.

The area of steel exposed through the formed metallic chromium layer, the electric contact resistance, the available range of secondary current in welding and the corrosion resistance after lacquering of the thus treated steel sheet in the above described Examples and Comparative examples were evaluated by the following testing methods after the measurement of the amounts of metallic chromium and chromium in insoluble hydrated chromium oxide by the fluorescent X-ray method.

The results are shown in the attached Table.

(1) Area of steel base exposed from the formed metallic chromium layer (Uniformity of metallic chromium layer).

The hydrated chromium oxide of the sample which was cut to a size of 50 mm×50 mm was dissolved by an immersion into 300 g/l of sodium chloride solution for 5 minutes at 95° C. After that, the sample was sealed with vinyl tape except for the tested area having a diameter of 30 mm. The current for the passivation of the steel base in the sealed sample was measured by using an anodic polarization method at 125 mV/min of a polarization speed. This current value corresponds to the area of the steel base exposed through the metallic chromium layer, namely, shows the uniformity of the metallic chromium layer.

(2) Electric contact resistance

At first, the sample was cut to a size of 20 mm×100 mm after heating at 210° C . for 20 minutes, and then a pair of samples were inserted into between a pair of a copper disk electrodes (diameter:65mm, thickness:2 mm) rotating at 5 m/min. The electric contact resistance was calculated from the voltage between a pair of the copper disk electrodes wherein 5 amperes of direct current was employed and 50 kg of load was added.

(3) Available range of secondary current in welding

The sample was cut to a size of 100 mm×50 mm after heating at 210° C. for 20 minutes. A pair of sample which was overlapped with a width of 0.4 mm was welded under 50 kg of load, 60 Hz of frequency at 7.2 m/min. The upper limit of secondary current was determined by the conditions in which some defect such as splashing was found and the lower limit of one was determined by the conditions in which the breakage occurred in the welded part by tearing test by using a large number of samples. Available secondary current range in welding was determined from the difference of the secondary current described above.

(4) Corrosion resistance after lacquering (Test 1)

The sample was baked at 210° C.for 10 minutes after coating with 60 mg/dm$^2$ of an epoxy-phenolic type of lacquer. The coated sample was immersed into the solution containing 1.5% of citric acid and 1.5% of sodium chloride for 2 weeks at 38° C., after the surface of the coated sample was cross-hatched with 10 μm of width and 15 μm of depth by a razor.

The corrosion in the scratched part of the coated sample was divided into 5 ranks, namely, 5 was excellent, 4 was good, 3 was fair, 2 was poor and 1 was bad.

(5) Filiform corrosion resistance after lacquering (Test 2)

The sample which was cross-hatched after lacquer coating in (4) was formed by an erichsen testing machine. The degree of rust in the scratched part of the formed sample which was immersed into a solution containing 3% of sodium chloride was divided into 5 ranks, namely 5 was excellent, 4 was good, 3 was fair, 2 was poor and 1 was bad, after the storage for 10 days under 85% of relative humidity at 45° C.

TABLE 1

| | Amount of $Cr^o$ (mg/m$^2$) | Amount of $Cr^{ox}$ (mg/m$^2$) | Area of steel exposed from $Cr^o$ layer (mA/30 mmΦ) | Electric contact resistance (mΩ) | Available secondary current range (A) | Corr. resistance after lacquering Test 1 | Corr. resistance after lacquering Test 2 |
|---|---|---|---|---|---|---|---|
| Example 1 | 50 | 5 | 44 | 15 | 150 | 5 | 4 |
| Example 2 | 85 | 3 | 18 | 18 | 150 | 5 | 4 |
| Example 3 | 55 | 6 | 34 | 20 | 125 | 5 | 5 |
| Example 4 | 80 | 4 | 32 | 18 | 125 | 5 | 4 |
| Example 5 | 60 | 3 | 34 | 20 | 150 | 5 | 4 |
| Comp. Ex. 1 | 18 | 10 | 800 | 80 | 25 | 5 | 4 |
| Comp. Ex. 2 | 4 | 5 | 1000 | 65 | 25 | 3 | 2 |
| Comp. Ex. 3 | 35 | 7 | 440 | 38 | 50 | 5 | 3 |
| Comp. Ex. 4 | 95 | 15 | 120 | 2 | 50 | 5 | 3 |
| Comp. Ex. 5 | 85 | 7 | 20 | 36 | 75 | 5 | 4 |

Remarks
*1 $Cr^o$ shows metallic chromium and $Cr^{ox}$ shows Cr in hydrated chromium oxide

What is claimed:

1. A method for producing a tin free steel sheet for welding at high speed having thereon essentially a double layer wherein said double layer consists of a lower layer of flatly deposited metallic chromium and an upper layer of insoluble hydrated chromium oxide wherein said upper layer is insoluble in the aqueous chromic acid solution from which the layers are deposited which consists of:

(1) forming three layers on said steel sheet consisting of a bottom layer of metallic chromium in the amount of 45-90 mg/m$^2$, a middle layer in the amount of 3-7 mg/m$^2$ hydrated chromium oxide as chromium insoluble in said chromic acid solution and an upper layer of hydrated chromium oxide soluble in said chromic acid solution by cathodic treatment at a cathodic current density of 20 to 100 $A/dm^2$ of a substantially clean steel sheet in a sulfate-free aqueous chromic acid solution consisting of water, 50 to 300 g/l chromic acid and one or more fluorine compounds in an amount of from 1.0 to 10.0 weight percent of the chromic acid at a temperature of 40°-60° C.;

(2) dissolving said soluble hydrated chromium oxide by an immersion of the steel sheet covered with said three layers formed by step (1) into the aqueous chromic acid solution in the absence of an applied electric current for an immersion time of 2.5-10 sec.; and (3) rinsing with water and drying.

2. The method of claim 1 wherein said fluoride compound is at least one compound selected from the group consisting of hydrofluoric acid, fluoboric acid, fluosilicic acid, ammonium bifluoride, an alkali metal bifluoride, ammonium fluoride, an alkali metal fluoride, ammonium fluoborate, an alkali metal fluoborate, ammonium fluosilicate, an alkali metal fluosilicate and aluminum fluoride.

3. A tin-free steel sheet having essentially a chromium bilayer as produced by the method of claims 1 or 2.

* * * * *

UNITED STATES PATENT AND TRADEMARK OFFICE

CERTIFICATE OF CORRECTION

PATENT NO. : 5,168,015

DATED : December 1, 1992

INVENTOR(S) : Nobuyoshi Shimizu, et al.

It is certified that error appears in the above-indentified patent and that said Letters Patent is hereby corrected as shown below:

Col. 1, line 7: delete "859033" and insert -- 359033 --.

Signed and Sealed this

Thirteenth Day of September, 1994

*Attest:*

*Attesting Officer*

BRUCE LEHMAN

*Commissioner of Patents and Trademarks*